United States Patent [19]

Nobuta

[11] Patent Number: 4,536,739

[45] Date of Patent: Aug. 20, 1985

[54] APPARATUS FOR COMMUNICATION OF INSTRUCTING INFORMATION

[75] Inventor: Yoshiji Nobuta, Nara, Japan

[73] Assignees: Mizuno Corporation; Sharp Kabushiki Kaisha, both of Osaka, Japan

[21] Appl. No.: 385,729

[22] Filed: Jun. 7, 1982

[30] Foreign Application Priority Data

Jun. 15, 1981 [JP] Japan ..... 56-93564

[51] Int. Cl.[3] ..... A63B 71/06

[52] U.S. Cl. ..... 340/323 R; 273/26 C; 340/825.44; 455/32; 455/66; 455/89; 455/344

[58] Field of Search ..... 340/323 R, 321, 825.52, 340/825.56, 825.44, 825.48, 825.68; 455/26, 30, 32, 613, 344, 603, 66, 89, 100; 273/25, 26 C

[56] References Cited

U.S. PATENT DOCUMENTS

| | | | |
|---|---|---|---|
| 4,143,368 | 3/1979 | Route et al. | 455/603 X |
| 4,229,829 | 10/1980 | Grunwald | 455/603 X |
| 4,382,256 | 5/1983 | Nagata | 340/825.48 X |
| 4,415,065 | 11/1983 | Sandstedt | 340/825.44 X |

*Primary Examiner*—James J. Groody

*Attorney, Agent, or Firm*—Joseph G. Seeber

[57] ABSTRACT

An apparatus for communication of instructing information comprises a transmitter (1), a receiver (2) and a data setting portion (5). A random access memory (22) of the transmitter (1) is in advance stored with a plurality of pieces of instructing data and any one of the pieces of instructing data, as stored, is read out and is displayed by a display (13). Any one of the pieces of instructing data is selected by a selection key (12) and the address data corresponding to the instructing data as selected is transmitted by the transmitter (18). On the other hand, the receiver (3) receives the transmitted address data. The receiver (3) is provided with a random access memory (37) for storing the instructing data as is similar to that of the transmitter (1). The corresponding instructing data is read from the random access memory (37) as a function of the received address data and the instructing information is reproduced as a speech sound by means of a speech synthesizing circuit (39). The instructing data stored in the random access memory (22) of the transmitter (1) and the random access memory (37) of the receiver (3) is arbitrarily changed by means of the data setting portion (5).

16 Claims, 17 Drawing Figures

| ADDRESS | INSTRUCTING INFORMATION | DISPLAY |
|---|---|---|
| 0 | SIGN AN OFF | SO |
| 1 | TAKE | TK |
| 2 | HIT BEHIND THE RUNNER | HR |
| 3 | HIT TO THE OPPOSITE FIELD | HO |
| 4 | DRAG BUNT | DB |
| 5 | STEAL | ST |
| 6 | DOUBLE STEAL | DS |
| 7 | HIT AND RUN | HR |

| ADDRESS | INSTRUCTING INFORMATION | DISPLAY |
|---|---|---|
| 8 | BUNT AND RUN | BR |
| 9 | SQUEEZE | SQ |
| A | | |
| B | | |
| C | | |
| D | | |
| E | | |
| F | | |

APPARATUS FOR COMMUNICATION OF INSTRUCTING INFORMATION

BACKGROUND OF THE INVENTION

1. Field of the Invention

The present invention relates to an apparatus for communication of instructing information. More specifically, the present invention relates to an apparatus for communication of instructing information such as a sign given from a manager, a coach or the like to players in various kinds of sports, for example.

2. Description of the Prior Art

In various kinds of sports, it is necessary that instructing information is given from a manager, a coach or the like to players as a sign without being known by the opponents. For example, in playing baseball, different kinds of motions of arms or bodies of a manager, a coach and the like are allotted in advance to different kinds of information such as a drug bunt, a hit and run and the like, and such sign is given in terms of different kinds of motions of arms, bodies and the like from a manager, a coach and the like to a batter standing at a batter box. However, such manner of transmitting a sign involves disadvantages in that the meaning of a sign is likely to be deciphered by the opponent team and such sign is not suited for communication in a tactical manner and the like. Further disadvantages are that time is required for confirming a sign before a batter stands at a batter box and accordingly the progress of a game is retarded.

Therefore, in order to eliminate such disadvantages, one approach may be thought of in which small sized receivers are held by the respective players and speech sound information representing a sign is transmitted to the receivers in a wireless manner from a transmitter held by a manager, a coach and the like. However, such manner of communication makes it possible for an opponent team to know the content of the sign by having the same receiver, thereby to make it impossible to keep secrecy. Therefore, it is desired that there is provided an apparatus for transmission of such sign with secrecy preserved. A variety of apparatuses capable of transmitting information in a confidential manner has been proposed and put into practical use in a variety of applications. However, any of such conventional secret communication apparatuses are complicated and expensive and large sized.

SUMMARY OF THE INVENTION

Briefly described, in accordance with the present invention a plurality of pieces of instructing information having different meanings are in advance determined and any one of the plurality of pieces of instructing information is selected and transmitted by a transmitter and the same is received by a receiver. More specifically, the transmitter comprises selecting means for individually selecting any one of the plurality of pieces of instructing information and transmitting means for transmitting address data corresponding to the selected piece of instructing information. On the other hand, the receiver comprises receiving means for receiving the address data transmitted by the transmitter, and output means responsive to the received address data for providing instructing information corresponding to the address data of the piece of instructing information selected by the selecting means of the transmitter. Changing means is further provided for changeably establishing in a consistent manner both a predetermined corresponding relation between the instructing information selected by the selecting means and the address data in the transmitter and a predetermined corresponding relation between the address data and the instructing information obtained from the output means in the receiver, thereby to cipher the instructing information in transmission.

According to the present invention, therefore, instructing information can be transmitted using a relatively simple structure and with secrecy preserved. More specifically, the address data transmitted from the transmitter may be changed from time to time with respect to the instructing information in exactly the same manner as the address data is changed in the receiver, using the changing means. Therefore, the corresponding relation between the address data and the instructing information cannot be known by an opponent team, even if a receiver of the same type is prepared and the transmitted address data is received thereby, and as a result the instructing information cannot be known and secrecy can be preserved.

In a preferred embodiment of the present invention, a plurality of pieces of instructing data are in advance stored in addresses identified by address data in a transmitter and the respective pieces of instructing data as stored are read out and displayed by the corresponding displays. Any one of them is individually selected and the address data corresponding to the selected piece of instructing data is transmitted. On the other hand, the address data as transmitted is received by a receiver. The receiver is also adapted to store a corresponding plurality of pieces of instructing data in addresses identified by the corresponding address data as done in the transmitter, and the piece of instructing data corresponding to the address data is read out in response to the address data as received, whereby a piece of instructing information corresponding to that piece of instructing data is reproduced in the form of a speech sound. The instructing information can also be displayed by a display. The transmitter and the receiver are adapted such that the instructing data as stored can be changed in exactly the same manner with respect to the address data to have a predetermined corresponding relation between the instructing data and the address data both in the transmitter and the receiver.

Therefore, according to the preferred embodiment of the present invention, the instructing information can be ciphered in a readily changeable manner by simply changing the addresses of the storages in the same manner both in the transmitter and the receiver and the instructing information can be communicated with secrecy preserved using a simple structure.

In a further preferred embodiment of the present invention, both a transmitter and a receiver are housed in a single housing as a set of transceiver, and by preparing two sets of transceivers, the instructing information can be transmitted and received in a bidirectional manner.

Accordingly, a principal object of the present invention is to provide an apparatus for communication of instructing information with secrecy preserved which is relatively simple in structure, inexpensive in cost, and is small sized.

One aspect of the present invention resides in an apparatus for communication of instructing information wherein a plurality of pieces of instructing information are stored in each of a transmitter and a receiver and a corresponding relation between the respective pieces of instructing information stored in the transmitter and receiver can be ciphered in a readily changeable manner in transmission.

Another aspect of the present invention resides in a transmitter and a receiver for transmission of instructing information wherein the instructing information is transmitted in a ciphered manner from the transmitter and is reproduced in the form of a speech voice or visual indication in the receiver.

These objects and other objects, features, aspects and advantages of the present invention will become more apparent from the following detailed description of the present invention when taken in conjunction with the accompanying drawings.

DETAILED DESCRIPTION OF THE DRAWINGS

Figures 1, 2:
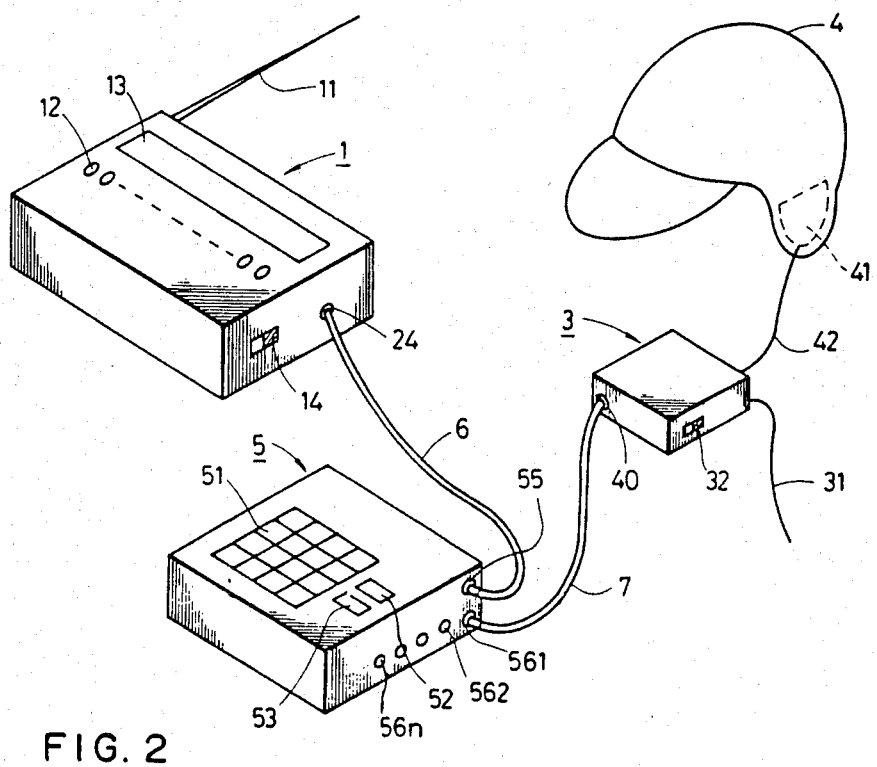
FIG. 1 is a perspective view of one embodiment of the present invention.
FIG. 2 is a table showing one example of signs to be transmitted and received in accordance with one embodiment of the present invention.

FIG. 1 is a perspective view of one embodiment of the present invention and FIG. 2 is a view for explaining a sign serving as an example of instructing information to be transmitted in accordance with the embodiment of the present invention.

First referring to FIGS. 1 and 2, an outline of the present invention will be described. The embodiment of the present invention shown in FIG. 1 comprises a transmitter 1, a receiver 3 and a data setting portion 5. The transmitter 1 comprises an antenna 11, selection keys 12, a display 13, and an address changing switch 14 serving as a mode selecting means. The display 13 is adapted to display various symbols corresponding to the respective signs shown in FIG. 2, such as a symbol SO for a sign an off, a symbol TK for a take, and the like. The embodiment shown is structured to be capable of transmitting sixteen kinds of signs and to that end the display 13 comprises sixteen display positions for displaying the sixteen kinds of signs. Each display position of the display 13 comprises a segment display which is capable of displaying two alphabet letters. The selection keys 12, serving as a selecting means for selecting a sign to be transmitted corresponding to one of the symbols in the display 13, are provided so as to correspond to the respective display positions in the display 13. The address changing switch 14 is provided so that the same is operated when the content of a random access memory for storing sign data serving as instructing data provided in the transmitter 1 is to be changed.

The receiver 3 comprises an antenna 31 and an address changing switch 32. The receiver 3 is coupled through a cable 42 to a speaker 41 built in a helmet 4. The changing switch 32 is operated when the sign data stored in a random access memory provided in the receiver 3 is to be changed. Assuming that a game is a baseball game, the receiver 3 is put in a pocket of a uniform of a batter and the helmet 4 is also put on his head. By selecting a sign to be transmitted using the selection keys 12 of the transmitter 1, the address data corresponding to the sign is transmitted from the antenna 11. The receiver 3 receives through the antenna 31 the address data corresponding to the sign thus transmitted. Then a speech sound representing the sign corresponding to the said address data is produced from the speaker 41 so that the batter may hear the same. Meanwhile, since a plurality of the receivers 3 can be used, the sign can be transmitted simultaneously to players such as runners other than the batter.

The setting portion 5 is also provided for changing in a consistent manner both a relation between the address data and the signs corresponding to the respective selection keys 12 in the transmitter 1 and such relation in the receiver 3. More specifically, the setting portion 5 is used for changing in exactly the same manner the contents of the respective addresses for the random access memories built in both the transmitter 1 and the receiver 3 with respect to sign data so that a new corresponding relation may be established both in the transmitter 1 and the receiver 3 in the same manner. To that end, the data setting portion 5 is coupled to a connector 24 of the transmitter 1 through a cable 6 from a connector 55 and is also coupled to a connector 40 of the receiver 3 through a cable 7 from a connector 561. The data setting portion 5 comprises keying input switches 51 for entering address data and sign data, an address setting key 52 for designating the data entered from the keying input switch 51 as address data, and a data setting key 53 for designating the data entered from the keying input switch 51 as sign data. By selecting the address selecting switch 14 of the transmitter 1 and the address selecting switch 32 of the receiver 3 and the by operating the keying input switches 51, the address setting key 52 and the data setting key 53, the contents in the random access memories built in both the transmitter 1 and the receiver 3 can be changed in exactly the same manner so that the new same corresponding relation between the signs and the address data may be established both in the transmitter 1 and the receiver 3. The data setting portion 5 is provided with a plurality of connectors 561 to 56n so that a plurality of receivers 3 may be connected thereto for simultaneously changing the data of the respective receivers 3 in exactly the same manner.

Figure 3:
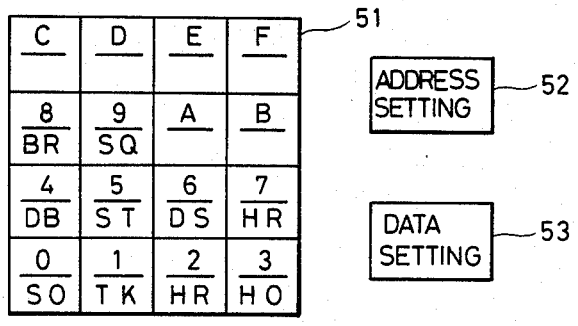
FIG. 3 is a view showing an arrangement of keys in a keyboard included in the data setting portion of the FIG. 1 embodiment.
Figure 4:
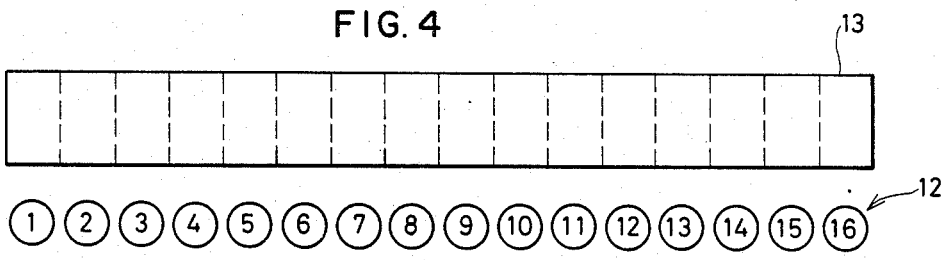
FIG. 4 is a view showing selection keys and displays included in the transmitting portion of the FIG. 1 embodiment.

FIG. 3 is a view showing an arrangement of the keys in a key board included in the data setting portion 5 shown in FIG. 1 and FIG. 4 is a view showing the selection keys 12 and the display 13 included in the transmitter 1.

First referring to FIG. 3, the keying input switches 51 includes sixteen keys, each being allotted a numeral (one of 0 to F) representing the address and a symbol (one of SO to SQ) representing a corresponding sign shown in FIG. 2. In changing a relation between the sign data and the address data, the keying input switch 51 such as the 0 key is operated and then the address setting key 52 is operated, whereby the address 0 of the random access memory is designated, and then, for example, the SO key is operated and the data setting key 53 is operated, whereby the sign data corresponding to SO is stored in the address 0.

Now referring to FIG. 4, the selecting keys 12 of the transmitter 1 comprise sixteen keys and the display 13 is also provided which has sixteen display positions corresponding to the respective selection keys.

Figure 5A:
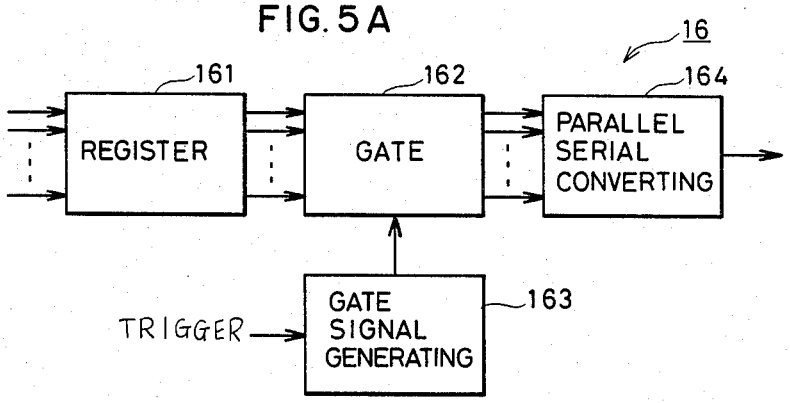
FIG. 5A is a block diagram of a repetitive data generating circuit of the FIG. 5 embodiment.
Figure 5:
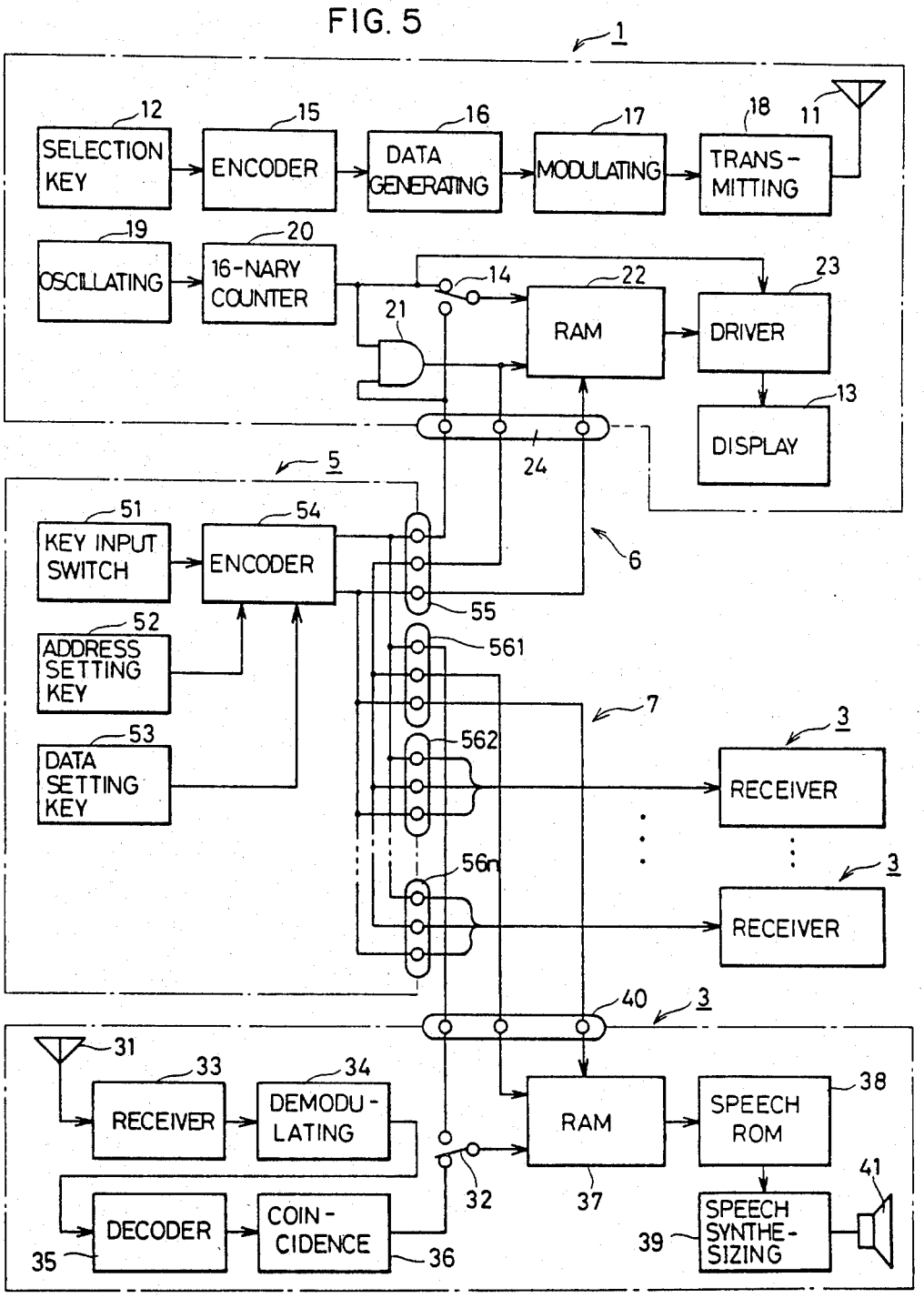
FIG. 5 is a block diagram of the embodiment of the present invention.

FIG. 5 is a block diagram of one embodiment of the present invention. Now a structural feature of the transmitter 1 will be described. When one of the selection keys 12 shown in FIG. 4 is operated, the selection signal is applied to an encoder 15 and the same is converted into address data. The address data is applied to a repetitive data generating circuit 16. The repetitive data generating circuit 16 is adapted to generate a plurality of times the corresponding address data when any one of the selection keys 12 is operated. The repetitive data generating circuit 16 converts the address data to be bit serial, which is then applied to a modulating circuit 17. The repetitive data generating circuit 16 will be described in more detail subsequently. The modulating circuit 17 frequency modulates the applied address data and the frequency modulated output is applied to a transmitting circuit 18. The transmitting circuit 18 transmits the address data from the antenna 11 using a carrier wave of 27 MHz which is of the citizen band.

An oscillating circuit 19 is provided for generating a clock signal, which is applied to a 16-nary counter 20. The 16-nary counter 20 provides an address signal of 4 bits by repetitively counting the clock signal. The address signal is applied through the address selection switch 14 to a random access memory 22. The count output signal from the 16-nary counter 20 is applied to one input of an AND gate 21. The other input of the AND gate 21 is connected to receive the address signal obtained from an encoder 54 included in the data setting portion 5. The output signal from the AND gate 21 is applied to the random access memory 22 as a write enable signal and is also applied through the connector 24, the cable 6, the connectors 55 and 561, the cable 7 and the connector 40 to the receiver 3. The random access memory 22 includes addresses 0 to F as shown in FIG. 2 for storing in the respective addresses the sign data of ASCII codes each of 7 bits for representing the symbols corresponding to the respective signs. The sign data read out from the random access memory 22 is applied to a display driver 23. The display driver 23 is supplied with the output from the 16-nary counter 20 as a display position signal. The display driver 23 drives the display 13 shown in FIG. 4. The data setting portion 5 comprises an encoder 54 for receiving the keying input signals obtained from the selection keys 51, the address setting key 52 and the data setting key 53. The encoder 54 is responsive to the keying input signals obtained from the respective keys 51, 52 and 53 to provide an address signal and sign data. The address signal is applied through the connector 55, the cable 6 and the connector 24 to the other input of the AND gate 21 and the address selection switch 14 and is also applied through the connector 561, the cable 7 and the connector 40 to the address selection switch 32 of the receiver 3. The sign data is applied through the connector 55, the cable 6 and the connector 24 to the random access memory 22 included in the transmitter 1 and is also applied through the connector 561, the cable 7 and the connector 40 to the random access memory 37 included in the receiver 3. The respective connectors 562 to 56n of the data setting portion 5 are also supplied with the address signal and the sign data and the write enable signal.

The receiver 3 receives through the antenna 31 by a receiving circuit 33 the electric wave transmitted from the antenna 11 of the transmitter 1. The receiving circuit 33 comprises a conventional well known superheterodyne receiver. The output signal from the receiving circuit 33 is demodulated by a demodulating circuit 34 and the demodulated output is applied to a decoder 35. The decoder 35 converts the bit serial address data into address data of a bit parallel fashion and the converted output is applied to a coincidence detecting circuit 36. The coincidence detecting circuit 36 determines coincidence of the address data transmitted a plurality of times from the transmitter 1. To that end, the coincidence detecting circuit 36 comprises a register, not shown, so that the address data received for the first time may be stored in the register and the address data received subsequently may be compared with the data stored in the register for detection of coincidence. If coincidence is detected, the said address data is applied to the address input of a random access memory 37 through the address selection switch 32. The random access memory 37 is supplied with the sign data from the data setting portion 5 and is also supplied with the write enable signal (WE) through the connector 24, the cable 6, the connectors 55 and 561, the cable 7 and the connector 40. The random access memory 37 may be structured in substantially the same manner as that of the random access memory 22 included in the transmitter 1 and is adapted to store the same sign data. The sign data read out from the random access memory 37 is applied to a speech read only memory 38. The speech read only memory 38 stores speech data necessary for producing a speech sound of the sign shown in FIG. 2. The sign data obtained from the random access memory 37 is used as an address signal of the speech read only memory 38 to designate a predetermined address of the speech read only memory 38. The speech data obtained from the speech read only memory 38 is applied to a speech synthesizing circuit 39, so that speech synthesization may be performed for producing a voice of a desired sign. The output from the speech synthesizing circuit 39 is applied to a speaker 41, so that a speech voice corresponding to sign may be produced.

FIG. 5A is a block diagram of a repetitive data generating circuit shown in FIG. 5. Referring to FIG. 5A, the repetitive data generating circuit 16 comprises a register 161, a gate circuit 162, a gate signal generating circuit 163, and a parallel/serial converting circuit 164. The register 161 is provided for temporarily storing the address data obtained from the encoder 15. The address data stored in the register 161 is applied to the gate circuit 162. On the other hand, when the selection key 12 shown in FIG. 5 is operated, a triggering signal is applied to the gate signal generating circuit 163. Accordingly, the gate signal generating circuit 163 generates a plurality of gate signals, which are applied to the gate circuit 162. Accordingly, each time the gate circuit 162 is repetitiously supplied with the gate signal, the gate is enabled so that the address data from the register 161 is applied to the parallel/serial converting circuit 164. The parallel/serial converting circuit 164 converts that address data of a bit parallel format into the address data of a bit serial format, which is then applied to the modulator 17 shown in FIG. 5.

Now referring to FIGS. 1 to 5, a specific operation of one embodiment of the present invention will be described. First the transmitter 1 is coupled through the cable 6 to the data setting portion 5 and the receiver 3 is coupled through the cable 7 to the data setting portion 5. Then the address selection switches 14 and 32 are turned to the data setting side. Then the keying input switch 51 shown in FIG. 3 is operated to designate the address and the address setting key 52 is operated. Then an address signal is obtained from the encoder 54 of the data setting portion 5. The address signal is applied to the address inputs of the random access memories 22 and 37 and is also applied to the AND gate 21. At that time the 16-nary counter 20 of the transmitter 1 repetitively counts the clock pulse obtained from the oscillating circuit 19. When the address signal obtained from the encoder 54 coincides with the count value in the 16-nary counter 20, the write enable signal is applied from the AND gate 21 to the random access memories 22 and 37. Then the sign data is entered using the keying input switch 51 and the data setting key 53 is operated, whereby the sign data is obtained from the encoder 54. The sign data comprises ASCII codes necessary for representing the symbol corresponding to each of the signs. By repeating the above described operation, the display sign data of the same symbol (two alphabets) is stored in each of the addresses of the random access memories 22 and 37.

Then the cables 6 and 7 are disconnected and the address selection switches 14 and 32 are turned to the operation mode side. The receiver 3 is then handed over to a batter and the transmitter 1 is handed over to a manager or a coach. The random access memory 22 of the transmitter 1 is responsive to turning of the address selection switch 14 to the operation mode side to provide the sign data from the respective addresses based on the count output signal of the 16-nary counter 20. Since the display driver 23 is supplied with a count output signal from the 16-nary counter 20 as a display position signal, the display driver 23 provides the display signals corresponding to the respective signs to the display 13 in succession in a time division fashion. Accordingly, the display 13 is driven so that the symbols representing the respective signs may be energized in the so-called dynamic driving manner. The manager or coach looks at the display of the respective signs in the display 13 and operates the selection key 12 corresponding to the position where a necessary sign is displayed. Then the keying input signal of the selection key 12 is applied to the encoder 15 and is converted into the address data. The address data is obtained a plurality of times by the repetitive data generating circuit 16 and is transmitted in the form of an electric wave through the modulating circuit 17 and the transmitting circuit 18 and from the antenna 11.

On the other hand, the receiver 3 held by the batter receives the electric wave transmitted from the transmitter 1 by the receiving circuit 33 through the antenna 31. The received signal is demodulated by the demodulating circuit 34 and is applied to the decoder 35 and the output from the decoder 35 is subjected to detection of coincidence by the coincidence detecting circuit 36. When the coincidence detecting circuit 36 detects coincidence of the received address data, the said address data is applied to the random access memory 37. Then the random access memory 37 reads out the sign data from the corresponding address and provides the same to the speech read only memory 38. The speech read only memory 38 reads necessary speech data from the corresponding address using the sign data as the address signal and the output is applied to the speech synthesizing circuit 39. The speech synthesizing circuit 39 is responsive to the speech data to produce a sound of the speech representing the corresponding sign from the speaker 41. Accordingly, the batter can hear the speech of that sign from the speaker 41 built in the helmet 4. In order to change a corresponding relation between the address data and the sign in the course of the game, again the transmitter 1 and the receiver 3 are coupled to the data setting portion 5 and, as described previously, the contents in the random access memory 22 and 37 are changed, so that the contents may not be known by an opponent team. Thus, any sign can be transmitted in a confidential manner.

Figure 6:
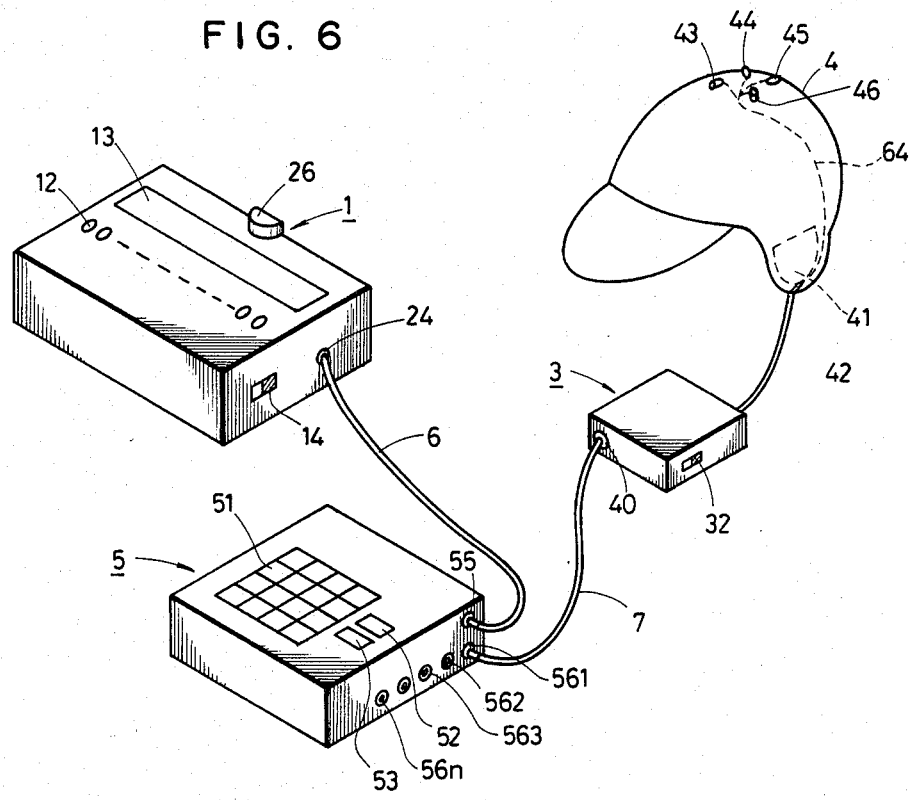
FIG. 6 is a perspective view of another embodiment of the present invention.
Figure 7A:
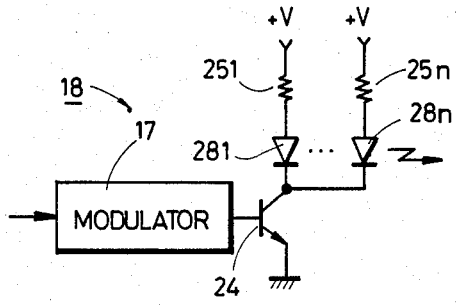
FIG. 7A is a view showing a transmitting portion of the other embodiment of the present invention.
Figure 7B:
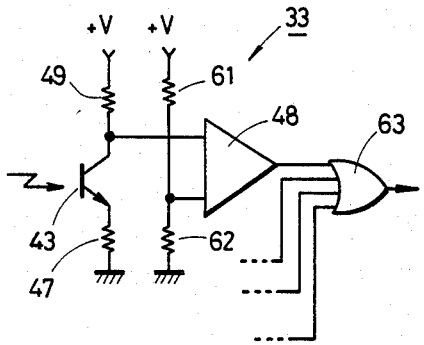
FIG. 7B is a view showing a receiving portion of the other embodiment of the present invention.

FIG. 6 is a perspective view of another embodiment of the present invention, FIG. 7A is a view showing a transmitting portion of the same, and FIG. 7B is a view showing a receiving portion of the same. Although the FIG. 5 embodiment was adapted such that the address data of the signs was transmitted and received in the form of an electric wave, the embodiment shown in FIGS. 6, 7A and 7B is adapted such that the address data is transmitted in the form of light. To that end, the transmitter 1 comprises a light head 26 in place of the previously described antenna 11. The light head 26 comprises a plurality of light emitting diodes 28*l* to 28*n* mounted in different directions, as shown in FIG. 7A. The cathodes of the respective light emitting diodes 28*l* to 28*n* are commonly connected to the collector of a transistor 24 and the respective anodes thereof are connected through resistors 25*l* to 25*n* to a direct current voltage source. The base of the transistor 24 is connected to the output of the previously described modulating circuit 17. Accordingly, the light emitting diodes 28*l* to 28*n* are turned on or off as a function of the output signal from the modulating circuit 17, whereby the address data is transmitted in the form of a light signal. Although the light emitting diodes 28*l* to 28*n* each cannot emit light with so wide a directivity, the embodiment shown is structured such that a plurality of light emitting diodes 28*l* to 28*n* are disposed to be directed in different directions so that in effect a relatively wide directivity can be achieved in transmitting the light signal. For example, by employing three light emitting diodes 28*l* to 28*n* each having the directivity angle of 45°, so that the directivity angle of each may overlap at both ends, an overall directivity angle of more than 100° can be attained in transmitting the light signal.

On the other hand, four phototransistors 43 to 46 are disposed at the top of a helmet 4 to be directed in different directions. The output signal of each of the phototransistors 43 to 46 is coupled through a cable 64 built in the helmet 4 to the receiver 3 to which the speaker 41 is also coupled through the cable 42. The emitter of the phototransistor 43 is connected through a resistor 47 to the ground and the collector is coupled to a comparison input of a comparator 48. The comparison input is also coupled through a resistor 49 to a direct current voltage source +V. A difference input of the comparator 48 is supplied with a voltage obtained by voltage division of the direct current voltage +V by means of resistors 61 and 62. The other phototransistors 44 to 46 are also coupled in the same manner to other comparators, not shown. The output signals from the respective comparators are applied through an OR gate 63 to the demodulating circuit 34 shown in FIG. 5. As described in the foregoing, according to the embodiment now in description, a plurality of the light emitting diodes 28*l* to 28*n* are disposed in the transmitter 1 so as to be directed in different directions so that the address data in the form of light may be transmitted with a relatively wide directivity angle and a plurality of phototransistor 43 to 46 are disposed at the receiving end so as to be in different directions to receive light from any directions. Therefore, each time a sign is transmitted, communication can be made between the transmitter 1 and the receiving end 3 without directing the transmitter 1 toward the receiving end 3 and directing the helmet 4 toward the transmitter 1. Therefore, the embodiment now in discussion can also achieve substantially the same effect as that of the previously described embodiment using an electric wave.

Figure 8:
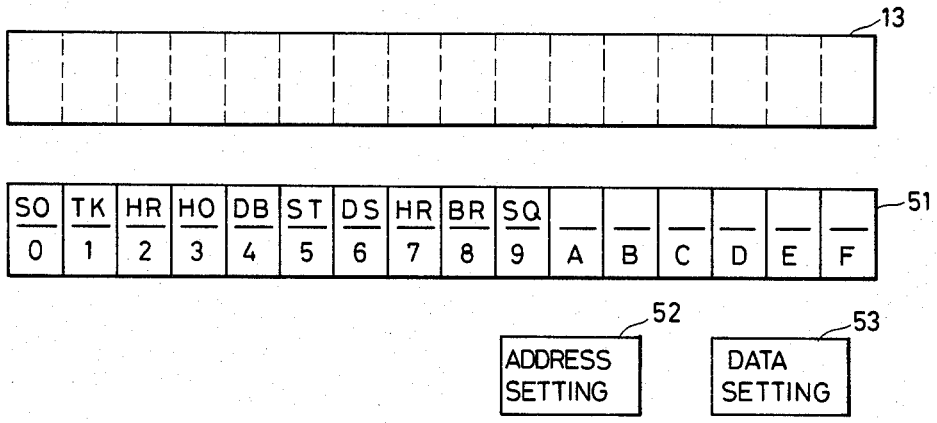
FIG. 8 is a view showing a keyboard and a display of the other embodiment of the present invention.
Figure 9:
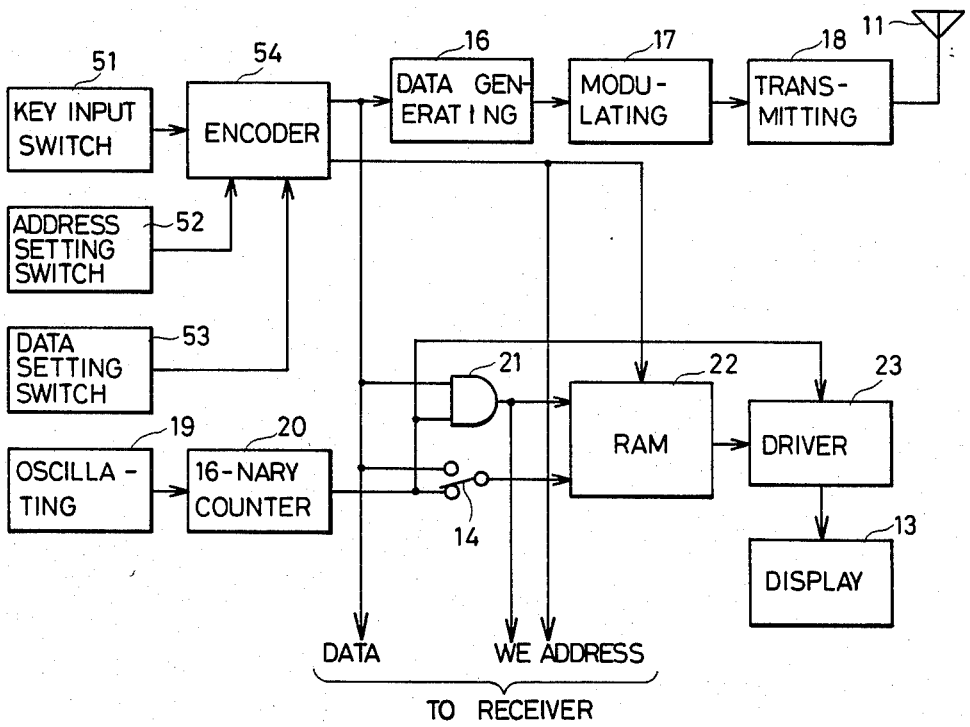
FIG. 9 is a block diagram of the other embodiment of the present invention.

FIG. 8 is a view showing a key board and a display of a further embodiment of the present invention and FIG. 9 is a block diagram of the same. The embodiment shown in FIGS. 8 and 9 is adapted such that the data setting portion 5 is built in the transmitter 1 and the keying input switch 51 shown in FIG. 3 and the selection key 12 shown in FIG. 4 are implemented by a common means. More specifically, the keying input switches 51 are each provided corresponding to the display positions of the display 13 and each keying input switch has an indication thereon indicating an address and a sign symbol. In setting the sign data, first an address is designated by the keying input switch 51, the address setting key 52 is then operated, and then the sign data is entered using the keying input switch 51 and thereafter the data setting key 53 is operated. In transmitting a sign, by looking at the symbol of a sign displayed on the display 13, the keying input switch 51 corresponding to that sign is operated.

According to the embodiment now in description, since the keying input switch 51 of the data setting portion 5 and the selection key 12 are implemented by a common means, as described previously, a separate provision of the selection key 12 shown in FIG. 5 can be dispensed with. The address data obtained from the encoder 54 is applied to the repetitive data generating circuit 16. The address data thereof is applied to the AND gate 21, the address selection switch 14 and the receiver 3. The data obtained from the encoder 54 is applied to the random access memory 22 and the random access memory 37 of the receiver 3. The other portions of the embodiment now in description are the same as those of the FIG. 5 embodiment.

Figure 10:
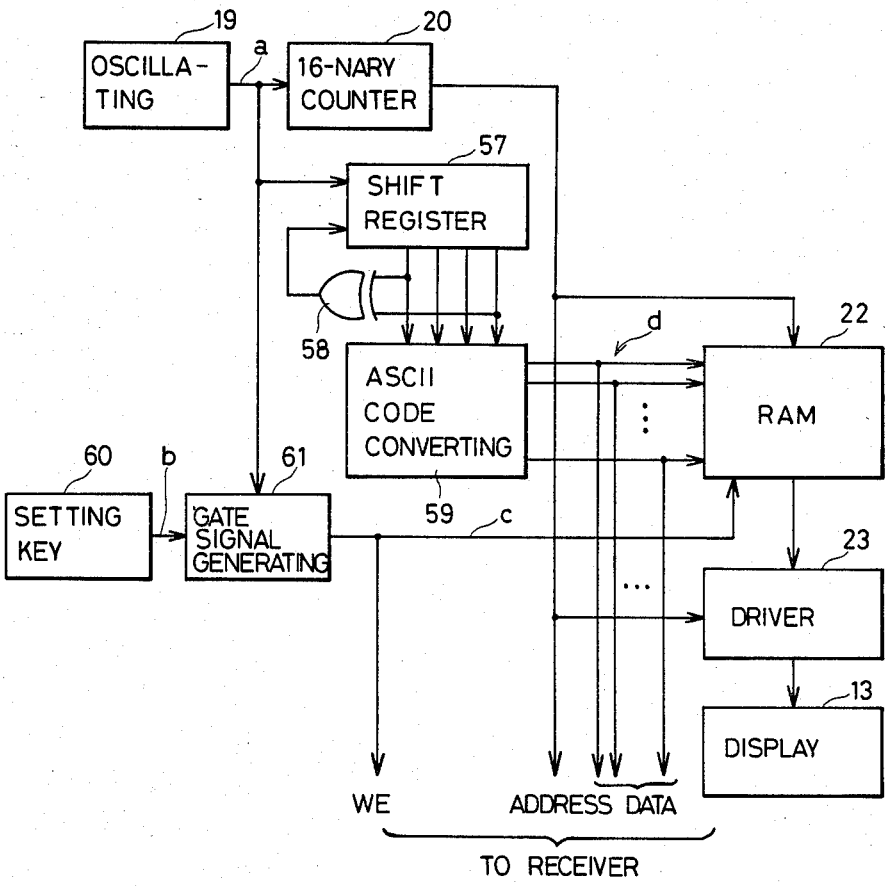
FIG. 10 is a block diagram of a data setting portion of a further embodiment of the present invention.

FIG. 10 is a block diagram of the data setting portion of the above described further embodiment of the present invention. The data setting portion 5 shown in FIG. 10 is structured such that in setting the address data in the random access memory 22 the sign data is generated at random without key inputting the address data and the sign data and then such data is stored in succession in the respective addresses of the random access memory 22. To that end, a new setting key 60 is provided and is used in renewing the contents in the random access memory 22. The output signal from the setting key 60 is applied to the gate signal generating circuit 61. The gate signal generating circuit 61 is supplied with a clock pulse from the oscillating circuit 19. The gate signal generating circuit 61 provides a gate signal corresponding to a period when sixteen clock pulses are counted, for example. The gate signal is applied to the random access memory 22 as a write enable signal. On the other hand, the count output signal of the 16-nary counter 20 for counting the clock pulses is applied as an address signal directly to the random access memory 22. A shift resistor 57 and an Exclusive OR gate 58 serve to generate a random signal. The shift resistor 57 is supplied with a clock pulse from the oscillating circuit 19. The shift output of the shift resistor 57 is fed back to the input of the same through the Exclusive OR gate 58. Accordingly, the shift resistor 57 is responsive to the clock pulse to provide a random output signal to an ASCII code converting circuit 59. The ASCII code converting circuit 59 is responsive to the signal obtained at random from the shift resistor 57 to provide ASCII codes corresponding to sixteen kinds of symbols necessary for displaying the signs. The ASCII codes are applied to the random access memory 22 and the random access memory 37 of the receiver 3.

Figure 11:
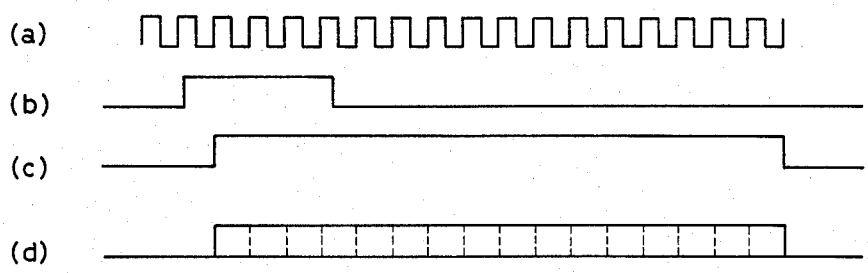
FIG. 11 is a graph showing waveforms of the electrical signals at various portions of the FIG. 10 diagram.

FIG. 11 is a graph showing waveforms of the signals at various portions in the FIG. 10 diagram. Now referring to FIG. 11, a specific operation of the FIG. 10 embodiment will be described. When the oscillating circuit 19 makes oscillation to provide a clock pulse as shown as (a) in FIG. 11, the 16-nary counter 20 counts the same, thereby to designate the addresses of the random access memory 22. When the setting key 60 is operated, the keying input signal shown as (b) in FIG. 11 is applied to the gate signal generating circuit 61. The gate signal generating circuit 60 is responsive to the keying input signal to provide a gate signal shown as (c) in FIG. 11 corresponding to the sixteen-clock pulse period, thereby to enable a write operation of the random access memory 22. On the other hand, the shift register 57 is responsive to the clock pulses to generate a random signal of four bits, which is applied to the ASCII code converting circuit 59. More specifically, the shift register 57 generates sixteen different codes during the gate period achieved by the output obtained from the gate signal generating circuit 61 shown as (d) in FIG. 11. The ASCII code converting circuit 59 is responsive to these sixteen different codes to convert the same into different ASCII codes, which are applied to the random access memory 22. Accordingly, the random access memory 22 stores as the sign data these different ASCII codes in succession in the addresses 0 to F thereof.

By thus operating the setting key 60, the sign data of the random access memory 22 can be changed at random with respect to the address data and therefore any complicated key operation can be dispensed with in changing the sign data with respect to the address data.

Although the above described embodiments were structured such that the speaker 41 is built in the helmet 4, the present invention is not limited thereto and alternatively an earphone may be connected to the receiver so that a speech sound corresponding to the sign may be produced from the earphone.

In a preferred embodiment the respective circuits of the receiver 1 may be implemented by integrated circuits so that the receiver may be compact and the same may be built in the helmet 4.

Figure 12:
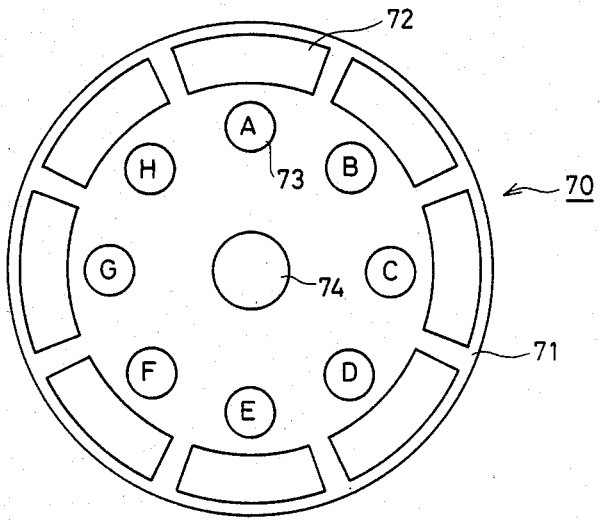
FIG. 12 is a view showing a selection key and a display of the further embodiment of the present invention.

FIG. 12 is a view showing a further embodiment of the present invention. The embodiment shown in FIG. 12 is structured such that the signs can be transmitted bidirectionally and the signs may be visually displayed without any speech sound being produced. More specifically, a transceiver 70 is housed in a disc-shaped housing 71. A plurality of displays 72 are disposed along the periphery of the surface of the housing 71. Films serving as instructing information displaying members having various kinds of signs indicated thereon are each attached onto the surface of each of the displays 72 and display lamps, not shown, are each disposed inside each of the displays 72. Accordingly, when the display lamp is lighted, the sign indicated on the film can be read. Meanwhile, the films are adapted to be readily exchangeable. The selection keys 73 are provided corresponding to the respective displays 72. The selection keys 73 are used for selecting any one of the signs indicated on the respective displays 72. A selection switch 74 is provided at the approximate center of the housing 71 for the purpose of selecting transmission and reception. Two such transceivers 70 shown in FIG. 12 are prepared and one transceiver 70 is held by a pitcher, for example, while the other transceiver 70 is held by a catcher, for example. If the catcher wishes to transmit a sign to the pitcher, the catcher operates the selection switch 74 and then operates the selection key 73. Then the sign data indicated by the display 72 corresponding to the selection key 73 is transmitted. The transmitted sign data is received by the transceiver 70 held by the pitcher and the corresponding display 72 is lighted. If the pitcher tries to transmit a sign to the catcher, the pitcher operates the selection switch 74 of the transceiver 70 the pitcher holds and then he operates the selection key 73.

Thus, when the pitcher and catcher hold their own transceivers 70 and transmit a sign, the content of the transmitted sign cannot be known by other persons such as runners.

Figure 13:
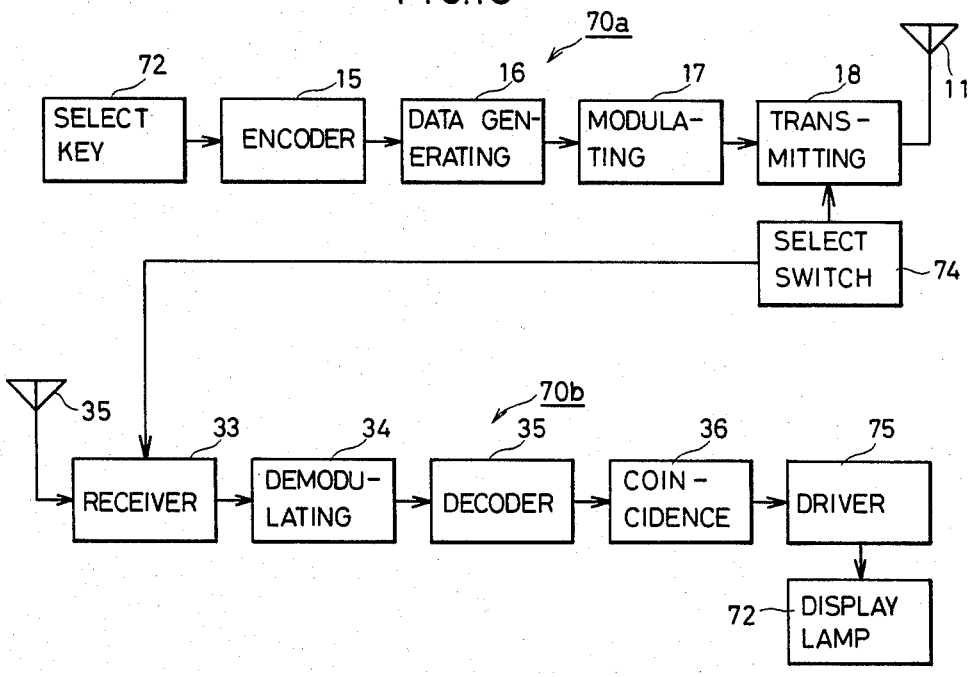
FIG. 13 is a block diagram of a transmitting portion and a receiving portion included in the further embodiment of the present invention.

FIG. 13 is a block diagram of a transmitter 70*a* and a receiver 70*b* included in the transceiver 70 shown in FIG. 12. The transmitter 70*a* is structured in substantially the same manner as that of the transmitting portion of sign data shown in FIG. 5, except that the selection switch 74 is coupled to the transmitting portion 18. When the selection switch 74 is operated, the transmitting portion 18 is enabled and the sign data selected by the selection key 72 is transmitted. The receiver 70*b* is structured in substantially the same as that of the receiving portion shown in FIG. 5, except that a display driver 75 is coupled to the output of the coincidence detecting circuit 36. The driver 75 comprises a decoder, not shown, and the display data obtained from the coincidence detecting circuit 36 is decoded and the decoded output is applied to the display 72. Meanwhile, the above described selection switch 74 is coupled to the receiving portion 33. When the selection switch 74 is operated, the receiving portion 33 is disabled.

As described in the foregoing, when the transmitter 70*a* and the receiver 70*b* are housed in the housing 71, an apparatus of a relatively simple structure is provided which can transmit the signs bidirectionally. If and when changing the contents of the signs with respect to the selection keys is desired, only a necessary step is to exchange the films so that the signs displayed by the respective displays 72 of the transceiver 70 held by the pitcher and the transceiver 70 held by the catcher may be consistent.

Meanwhile, although the above described embodiment was adapted such that the contents of the signs may be changed by exchanging the films of the respective displays 72, by adopting a structure in which the respective displays 72 may be rotated about the center of the housing 71, a corresponding relation between the respective selection keys 73 and the respective displays 72 can be readily changed.

Figure 14:
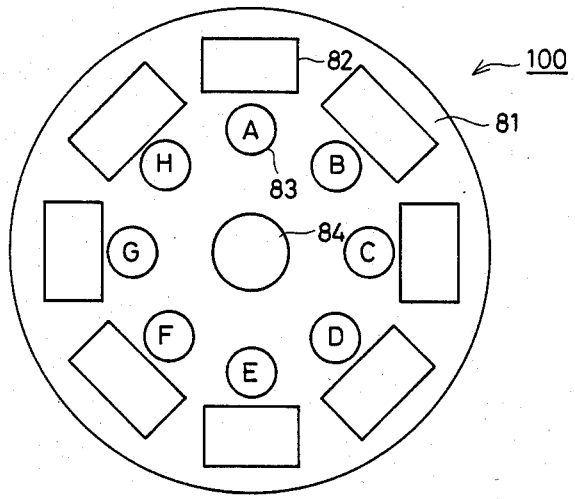
FIG. 14 is a view showing a selection key and a display of the further embodiment of the present invention.

FIG. 14 is a view showing still a further embodiment of the present invention. The FIG. 14 embodiment comprises an improvement on the FIG. 1 embodiment and is adapted such that the signs can be transmitted bidirectionally using visual display, in which major portions of the transmitter 70*a* and the receiver 70*b* are the same as those of the FIG. 1 embodiment. More specifically, the housing 81 is formed in a disc-shape as done in the FIG. 12 embodiment and a plurality of displays 82 are disposed on the periphery thereof. Liquid crystal displays are utilized as the displays 82. The selection keys 83 are provided corresponding to the respective displays 82. The selection switch 84 is provided at the approximate center of the housing 81 for selecting transmission and reception.

Figure 15:
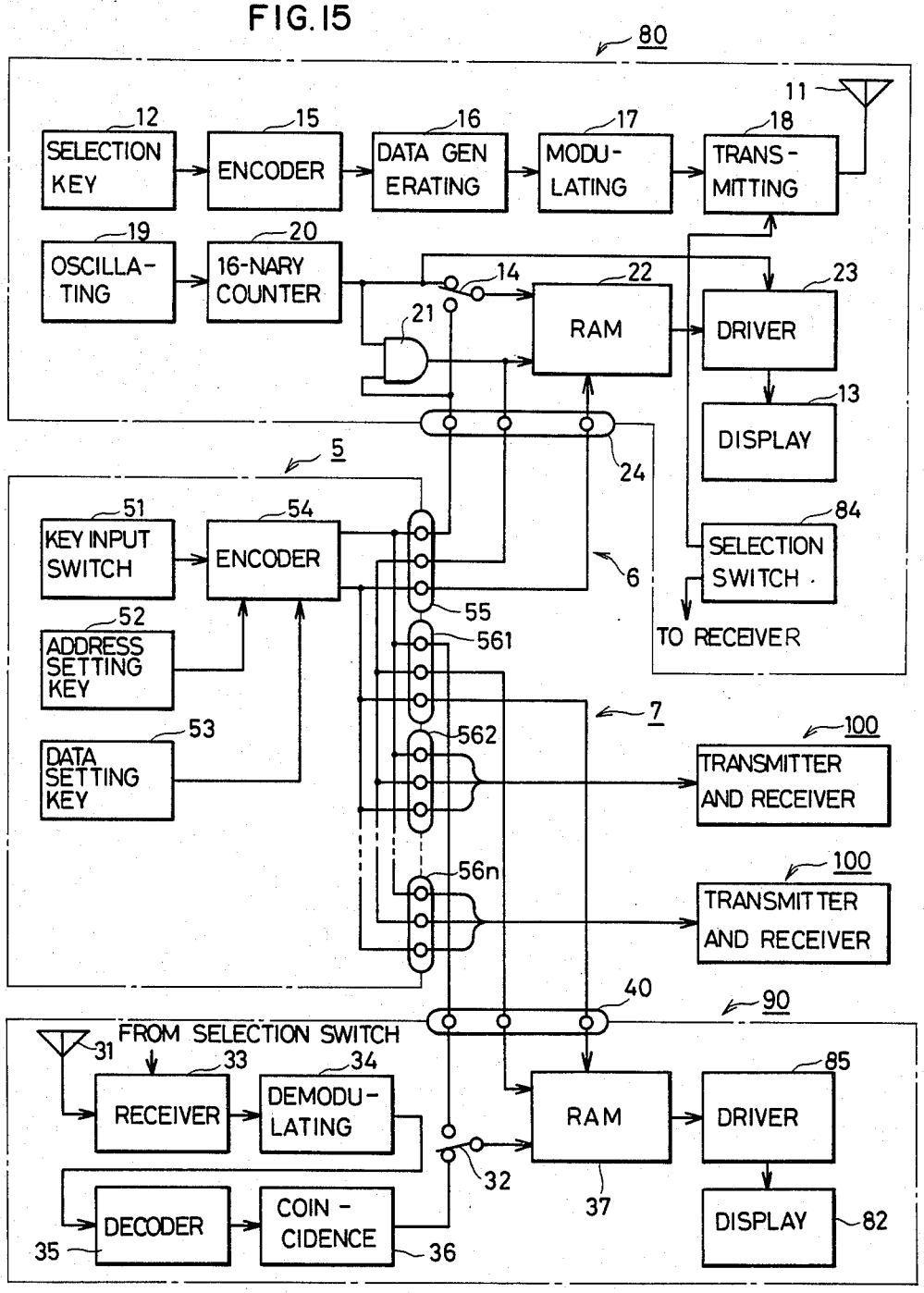
FIG. 15 is a block diagram of the further embodiment of the present invention.

FIG. 15 is a block diagram of the transmitting portion 80 and the receiving portion 90 housed in the housing 81 and the data setting portion 5 coupled to the housing 81 shown in FIG. 14. The transmitting portion 80 shown in FIG. 15 is substantially the same as the transmitting portion 1 shown in FIG. 5, except that the selection switch 84 is coupled to the transmitter 18. The receiving portion 90 is also substantially the same as that of the FIG. 14 embodiment, except that the driver 85 and the display 82 are provided in place of the speech read only memory 38 and the audio synthesizer 39. The driver 85 comprises the decoder so that the sign data obtained from the random access memory 37 may be decoded, which decoded output is applied to the display 82. Meanwhile, the connector 24 of the transmitting portion 80, the connector 40 of the receiving portion 90, and the mode selecting switches 14 and 32 are disposed on the rear surface of the housing 81.

Now an operation of the above described embodiment will be described. Two transceivers 100 are prepared and are held by a pitcher and a catcher, respectively. When a catcher is about to transmit a sign to the pitcher, the catcher operates the selection switch 84 and then operates any one of the selection keys 83. Then the sign data corresponding to the sign displayed by the display 82 corresponding to the operated selection key is transmitted. On the other hand, unless the pitcher operates the selection switch 84, the transmitted sign data is displayed on the display 82 of the transceiver held by the pitcher. The contents of the sign data can be readily changed in the case of the above described embodiment as well by using the data setting portion 5 as done in the FIG. 5 embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus for communication of instructing information, including a transmitter for transmitting a selected one of a plurality of pieces of instructing information having different meanings, and a receiver for receiving the transmitted selected one of a plurality of pieces of instructing information;

said transmitter including:

first storage means having a plurality of addresses for storing, in respective addresses, a plurality of pieces of instructing data corresponding to said plurality of pieces of instructing information, display means, including displaying regions respectively capable of displaying said plurality of pieces of instructing information, for reading out the plurality of pieces of instructing data stored in said first storage means and for correspondingly displaying the plurality of pieces of instructing information in respective displaying regions, selecting means comprising selectors, one for each of said displaying regions in said display means, for selecting any of said plurality of pieces of instructing information being displayed in a corresponding respective displaying region, and transmitting means responsive to selection of any of the plurality of pieces of instructing information by said selecting means for transmitting a corresponding address signal corresponding to each said piece of instructing information selected by said selecting means; and said receiver including:

receiving means for receiving each corresponding address signal transmitted by said transmitting means, second storage means, having corresponding addresses corresponding to said respective addresses of said first storage means, for storage in the corresponding addresses corresponding data corresponding to said plurality of pieces of instructing data stored in said first storage means, output means responsive to each corresponding address signal received by said receiving means for reading out data from the corresponding addresses of said second storage means based on each corresponding address signal received, and for providing the data thus read out as instructing data corresponding to each said piece of instructing information selected by said selecting means in said transmitter;

said apparatus for communication further comprising:

data changing means for changing any piece of instructing data stored in a respective address in said first storage means and for changing said corresponding data stored in said corresponding address in said second storage means while establishing, in a consistent manner, both a corresponding relation between said piece of instructing information selected by said selecting means and said corresponding address signal transmitted by said transmitting means in said transmitter, and a corresponding relation between said corresponding address signal received by said receiving means and said instructing information corresponding to said instructing data provided by said output means in said receiver.

2. An apparatus for communication of instructing information in accordance with claim 1, wherein said output means comprises sound producing means for producing a sound representing said piece of instructing information corresponding to said instructing data read from said second storage means.

3. An apparatus for communication of instructing information in accordance with claim 1, wherein said output means comprises display means for displaying said piece of instructing information corresponding to said instructing data read from said second storage means.

4. An apparatus for communication of instructing information in accordance with claim 1, wherein said data changing means comprises:

address setting means for commonly setting the respective addresses of said first storage means and the corresponding addresses of said second storage means, and instructing data entry means for entering instructing data in common to both the respective addresses of said first storage means and the corresponding addresses of said second storage means as set by said address setting means.

5. An apparatus for communication of instructing information in accordance with claim 1, wherein said data changing means comprises:

clock pulse generating means for generating a clock pulse, address designating means responsive to the clock pulse from said clock pulse generating means for designating commonly and successively the respective addresses of said first storage means and the corresponding addresses of said second storage means, and instructing data generating means responsive to the clock pulse from said clock pulse generating means for generating in succession a plurality of different pieces of instructing data and for providing the generated plurality of different pieces of instructing data for storage in the respective addresses of said first storage means and in the corresponding addresses of said second storage means as designated by said address designating means.

6. An apparatus for communication of instructing information in accordance with claim 1, wherein said transmitter and said receiver each comprise mode selecting means for selecting a mode in which the instructing data is stored in both said first storage means and said second storage means by said data changing means.

7. An apparatus for communication of instructing information in accordance with claim 1, wherein:

said transmitting means transmits said address signals in the form of an electric wave, and said receiving means receives said address signals as transmitted : in the form of an electric wave.

8. An apparatus for communication of instructing information in accordance with claim 1, wherein said transmitting means comprises a light emitting portion for emitting light representing said address signals, and said receiving means comprises a light receiving portion for receiving said light transmitted representing address signals.

9. An apparatus for communication of instructing information in accordance with claim 8, wherein said light emitting portion comprises a plurality of light emitting means disposed to emit light in different directions, and said light receiving portion comprises a plurality of light receiving means disposed to receive the light from different directions.

10. An apparatus for communication of instructing information in accordance with claim 1, wherein said transmitter and said receiver are implemented in a single unit, two of said single units being used for bidirectional transmission and reception.

11. An apparatus for communication of instructing information in accordance with claim 1, wherein said apparatus includes a display, and wherein:

said output means comprises a display lamp for being lighted in response to said each corresponding address signal received by said receiving means, and said data changing means comprises instructing information indication members having instructing information indicated thereon and detachably provided on said display for indicating said instructing information when said display lamp is lighted.

12. An apparatus for communication of instructing information in accordance with claim 1, wherein said data changing means is provided in said transmitter of said apparatus.

13. An apparatus for communication of instructing information in accordance with claim 4, wherein said address setting means and said selecting means are provided in said transmitter of said apparatus, said address setting means and said selecting means comprising a common keyboard for designating any one of said respective addresses of said first storage means and said corresponding addresses of said second storage means in an address setting mode, and for selecting said any one of said plurality of pieces of instructing information in a selection mode.

14. An apparatus for communication of instructing information, including a transmitter for transmitting a selected one of a plurality of pieces of instructing information having different meanings, and a receiver the transmitted selected one of a plurality of pieces of instructing information;

said transmitter including:

selecting means for individually selecting any one of said plurality of pieces of instructing information, and transmitting means for transmitting address data corresponding to said any one of said plurality of pieces of instructing information selected by said selecting means; and said receiver including:

receiving means for receiving the address data transmitted by said transmitting means, and output means responsive to the address data received by said receiving means for providing instructing data corresponding to said any one of said plurality of pieces of instructing information selected by said selecting means;

said apparatus for communication of instructing information further comprising:

data changing means for changeably establishing, in a consistent manner, both a corresponding relation between said any one of said plurality of pieces of instructing information selected by said selecting means and said address data transmitted by said transmitting means in said transmitter, and a corresponding relation between said address data received by said receiving means and said instructing data provided by said output means in said receiver;

wherein said apparatus includes a display, and wherein:

said output means comprises a display lamp for being lighted in response to the address data received by said receiving means, and said data changing means comprises instructing information indicating members having instructing information indicated thereon and detachably provided on said display for indicating said instructing information when said display lamp is lighted.

15. An apparatus for communication of instructing information, including a transmitter for transmitting a selected one of a plurality of pieces of instructing information having different meanings, and a receiver for receiving the transmitted selected one of a plurality of pieces of instructing information;

said transmitter including:

selecting means for individually selecting any one of said plurality of pieces of instructing information, and transmitting means for transmitting address data corresponding to said any one of said plurality of pieces of instructing information selected by said selecting means; and said receiver including:

receiving means for receiving the address data transmitted by said transmitting means, and output means responsive to the address data received by said receiving means for providing instructing data corresponding to said any one of said plurality of pieces of instructing information selected by said selecting means;

said apparatus for communication of instructing information further comprising:

data changing means for changeably establishing, in a consistent manner, both a corresponding relation between said any one of said plurality of pieces of instructing information selected by said selecting means and said address data transmitted by said transmitting means in said transmitter, and a corresponding relation between said address data received by said receiving means and said instructing data provided by said output means in said receiver;

wherein said data changing means is provided in said transmitter of said apparatus.

16. An apparatus for communication of instructing information, including a transmitter for transmitting a selected one of a plurality of pieces of instructing information having different meanings, and a receiver for receiving the transmitted selected one of a plurality of pieces of instructing information;

said transmitter including:

selecting means for individually selecting any one of said plurality of pieces of instructing information, and transmitting means for transmitting address data corresponding to said any one of said plurality of pieces of instructing information selected by said selecting means; and said receiver including:

receiving means for receiving the address data transmitted by said transmitting means, and output means responsive to the address data received by said receiving means for providing instructing data corresponding to said any one of said plurality of pieces of instructing information selected by said selecting means;

said apparatus for communication of instructing information further comprising:

data changing means for changeably establishing, in a consistent manner, both a corresponding relation between said any one of said plurality of pieces of instructing information selected by said selecting means and said address data transmitted by said transmitting means in said transmitter, and a corresponding relation between said address data received by said receiving means and said instructing data provided by said output means in said receiver;

wherein said transmitter further comprises:

first storage means having a plurality of addresses for storing, in respective addresses, a plurality of pieces of instructing data corresponding to said plurality of pieces of instructing information, and display means associated with said selecting means and responsive to the selection of said any one of said plurality of pieces of instructing information by said selecting means for displaying same in accordance with corresponding said instructing data stored in said first storage means; and wherein said receiver further comprises:

second storage means having corresponding addresses, corresponding to respective addresses of said first storage means, for storing additional data corresponding to said instructing data stored in said first storage means, and read means responsive to the address data received by said receiving means for reading corresponding said additional data from said second storage means and for providing same to said output means;

wherein said data changing means comprises data setting means for commonly changing the instructing data stored in said first storage means and the corresponding additional data stored in said second storage means for each of said respective addresses and said corresponding addresses, respectively;

wherein said data setting means comprises:

address setting means for commonly setting the respective addresses of said first storage means and the corresponding addresses of said second storage means, and instructing data entry means for commonly entering instructing data in the respective addresses of said first storage means and the corresponding addresses of said second storage means in accordance with the common setting of the respective addresses of the first storage mean and the corresponding addresses of said second storage means by said address setting means;

wherein said address setting means and said selecting means are provided in said transmitter of said apparatus, said address setting means and said selecting means comprising a common keyboard for designating any one of said respective addresses of said first storage means and said corresponding addresses of said second storage means in an address setting mode, and for selecting said any one of said plurality of pieces of instructing information in a selection mode.

* * * * *